US008837990B2

(12) United States Patent
Nelson et al.

(10) Patent No.: US 8,837,990 B2
(45) Date of Patent: Sep. 16, 2014

(54) LIQUID ELECTROPHOTOGRAPHY INK DEVELOPER

(75) Inventors: Eric G. Nelson, San Diego, CA (US); David E. Sabo, San Diego, CA (US); Evgeny Korol, San Diego, CA (US); Daniel P. Fradl, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 95 days.

(21) Appl. No.: 13/636,599

(22) PCT Filed: Apr. 2, 2010

(86) PCT No.: PCT/US2010/029834

§ 371 (c)(1),
(2), (4) Date: Sep. 21, 2012

(87) PCT Pub. No.: WO2011/123137

PCT Pub. Date: Oct. 6, 2011

(65) Prior Publication Data

US 2013/0011162 A1 Jan. 10, 2013

(51) Int. Cl.
*G03G 15/10* (2006.01)

(52) U.S. Cl.
CPC ..... *G03G 15/104* (2013.01); *G03G 2215/0634* (2013.01)
USPC ..... 399/237; 399/241

(58) Field of Classification Search
USPC ..... 399/237, 239, 241, 246
See application file for complete search history.

(56) References Cited

U.S. PATENT DOCUMENTS

| | | | | |
|---|---|---|---|---|
| 5,708,937 | A * | 1/1998 | Lestrange et al. | 399/239 |
| 5,974,292 | A | 10/1999 | Domoto et al. | |
| 2006/0153596 | A1 * | 7/2006 | Gilan et al. | 399/237 |
| 2006/0153597 | A1 * | 7/2006 | Guzman et al. | 399/237 |
| 2006/0291907 | A1 | 12/2006 | Tanner et al. | |
| 2009/0080939 | A1 | 3/2009 | Sabo et al. | |

FOREIGN PATENT DOCUMENTS

| | | | |
|---|---|---|---|
| EP | 0 250 098 | A2 | 12/1987 |
| EP | 1 679 556 | A1 | 7/2006 |
| WO | WO-2011123137 | | 10/2011 |

OTHER PUBLICATIONS

Hewlett-Packard Development Company, L.P., PCT Int'l Search Report & Written Opinion mailed Nov. 26, 2010, PCT/US2010/029834, filed Apr. 2, 2010, 8 p.

* cited by examiner

*Primary Examiner* — Sophia S Chen

(57) ABSTRACT

A developer flows ink from the ink inlet chamber along a first side of a first electrode, through a gap between the first electrode and a developer roller and back to the inlet chamber.

15 Claims, 6 Drawing Sheets

LIQUID ELECTROPHOTOGRAPHY INK DEVELOPER

CROSS-REFERENCE TO RELATED APPLICATION

The present application is the U.S. National Stage under 35 U.S.C. §371 of International Patent Application No. PCT/US2010/029834, filed 2 Apr. 2010, the disclosure of which is hereby incorporated herein by reference.

BACKGROUND

Liquid electrophotography (LEP) printing systems form images with liquid toner or ink applied to an electrophotographic surface by one or more developers. Existing developers occupy valuable space along the electrophotographic surface, are subject to manufacturing variations and sometimes result in non-uniform ink development or streaking.

DETAILED DESCRIPTION OF THE EXAMPLE EMBODIMENTS

Figure 1:
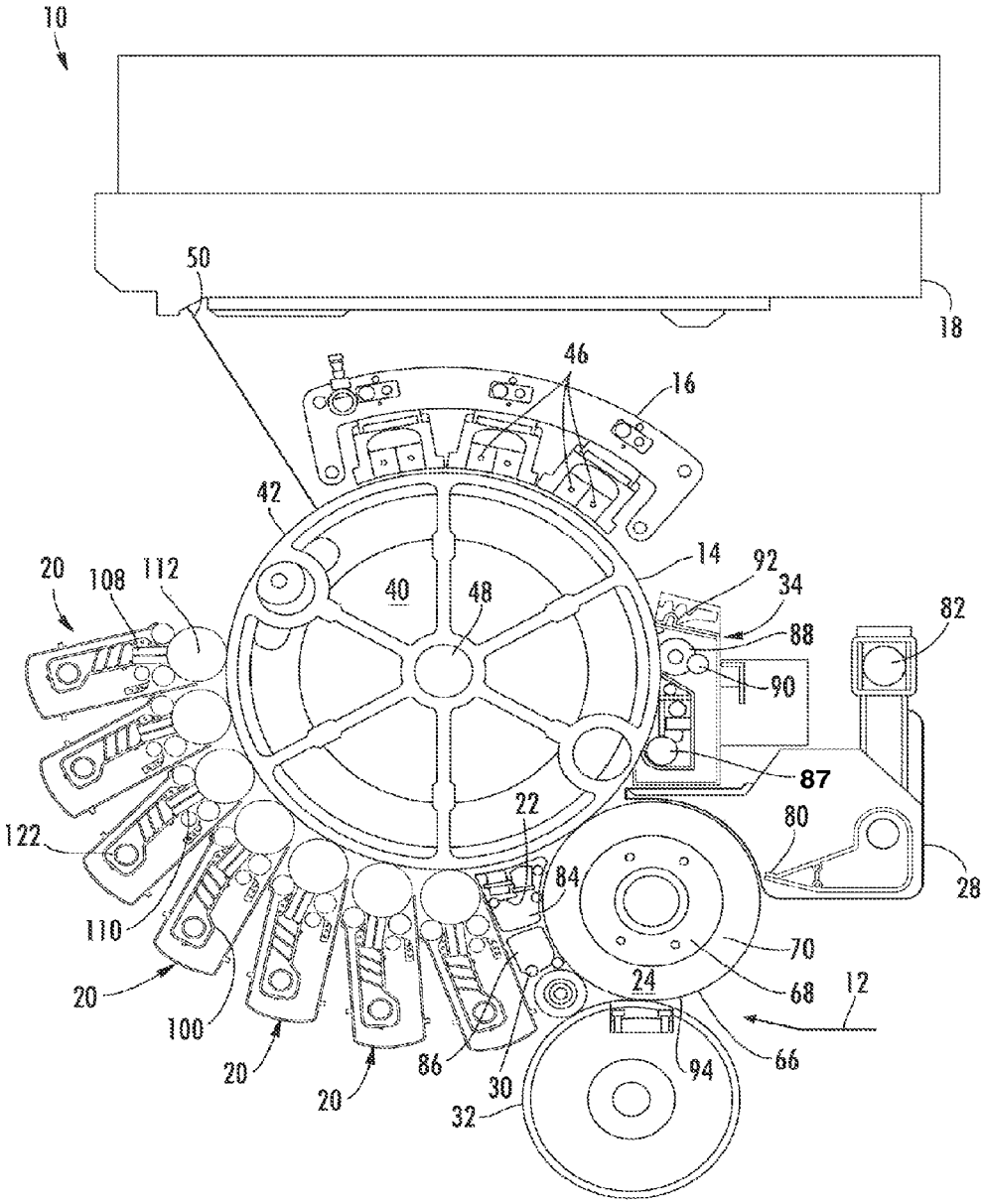
FIG. 1 is a sectional view of a printer according to an example embodiment.

FIG. 1 is a schematic illustration of an imaging system or printer 10, sometimes embodied as part of an offset color press, configured to form an image upon a print medium 12 according to one exemplary embodiment. Printer 10 includes developers 20. As will be described hereafter, each of developers 20 has an architecture that provides enhanced flexibility for the size, shape and positioning of its development electrodes. This flexibility facilitates a more compact developer unit that allows greater manufacturing tolerances and that may provide enhanced development uniformity and performance.

In addition to developer units or developers 20, printer 10, includes photoconductor 14, charger 16, imager 18, charge eraser 22, intermediate transfer member 24, dryers 28, 30, impression member 32 and photoconductor cleaning station 34. Photoconductor 14 generally comprises a cylindrical drum 40 supporting an electrophotographic surface 42, sometimes referred to as a photo imaging plate (PIP). Electrophotographic surface 42 comprises a surface configured to be electrostatically charged and to be selectively discharged upon receiving light from imager 18. Although surface 42 is illustrated as being supported by drum 40, surface 42 may alternatively be provided as part of an endless belt supported by a plurality of rollers. In such an embodiment, the exterior surface of the endless belt may be configured to be electrostatically charged and to be selectively discharged for creating an electrostatic field in the form of an image.

Charger 16 comprises a device configured to electrostatically charge surface 42. In the particular example shown, charger 16 includes 6 corotrons or scorotrons 46. In other embodiments, other devices for electrostatically charging surface 42 may be employed.

Imager 18 generally comprises any device configured to direct light upon surface 42 so as to form an image. In the example shown, imager 18 comprises a scanning laser which is moved across surface 42 as photoconductor 14 is rotated about axis 48. Those portions of surface 42 which are impinged by the light or laser 50 become electrically conductive and discharge electrostatic charge to form an image (and latent image) upon surface 42.

Although imager 18 is illustrated and described as comprising a scanning laser, imager 18 may alternatively comprise other devices configured to selectively emit or selectively allow light to impinge upon surface 42. For example, in other embodiments, imager 18 may alternatively include one or more shutter devices which employ liquid crystal materials to selectively block light and to selectively allow light to pass through to surface 42. In other embodiments, imager 18 may alternatively include shutters which include individual micro or nano light blocking shutters which pivot, slide or otherwise physically move between the light blocking and light transmitting states.

In still other embodiments, surface 42 may alternatively comprise an electrophotographic surface including an array of individual pixels configured to be selectively charged or selectively discharged using an array of switching mechanisms such as transistors or metal-insulator-metal (MIM) devices forming an active array or a passive array for the array of pixels. In such an embodiment, charger 16 may be omitted.

Developer units 20 comprise devices configured to apply printing material to surface 42 based upon the electrostatic charge upon surface 42 and to develop the image upon surface 42. In the particular example shown, printing material generally comprises a liquid or fluid ink comprising a liquid carrier and colorant particles. The colorant particles may have a size of less than 2 microns, although other sizes may be employed in other embodiments. In the example illustrated, printing material generally includes up to 6% by weight, and nominally 2% by weight, colorant particles or solids prior to being applied to surface 42. In one embodiment, the colorant particles include a toner binder resin comprising hot melt adhesive. In one particular embodiment, printing material comprises HEWLETT-PACKARD ELECTRO INK commercially available from Hewlett-Packard. As will be described hereafter with respect to FIG. 2, each developer unit 20 has an architecture that provides enhanced flexibility for the size, shape and positioning of its development electrodes. This flexibility facilitates a more compact developer unit that allows greater manufacturing tolerances and that may provide enhanced development uniformity and performance.

Charge eraser 22 comprises a device situated along surface 42 and configured to remove residual charge from surface 42. In one embodiment, charge eraser 22 may comprise an LED erase lamp. In particular embodiments, eraser 22 may comprise other devices or may be omitted.

Intermediate transfer member 24 comprises a member configured to transfer printing material from surface 42 to print medium 12. Intermediate transfer member 24 includes an exterior surface 66 which is resiliently compressible and which is configured to be electrostatically charged. Because surface 66 is resiliently compressible, surface 66 conforms and adapts to irregularities on print medium 12. Because surface 66 is configured to be electrostatically charged, surface 66 may be charged to a voltage so as to facilitate transfer of printing material from surface 42 to surface 66.

In the particular embodiment shown, intermediate transfer member 24 includes drum 68 and an external blanket 70 which provides surface 66. Drum 68 generally comprises a cylinder supporting blanket 70. In one embodiment, drum 68 is formed from a thermally conductive material, such as a metal like aluminum. In such an embodiment, drum 68 houses an internal heater (not shown) which heats surface 66.

Blanket 70 wraps about drum 68 and provides surface 66. In one particular embodiment, blanket 70 is adhered to drum 68. Blanket 70 includes one or more resiliently compressible layers and includes one or more electrically conductive layers, enabling surface 66 to conform and to be electrostatically charged. Although intermediate transfer member 24 is illustrated as comprising drum 68 supporting blanket 70 which provides surface 66, intermediate transfer member 24 may alternatively comprise an endless belt supported by a plurality of rollers in contact or in close proximity to surface 42 and compressible roller 32.

Dryers 28 and 30 comprise devices configured to facilitate partial drying of printing material upon surface 66. Dryers 28 and 30 are arranged about intermediate transfer member 24 and configured to direct air towards surface 66 and to withdraw air from surface 66. In the particular example shown, dryer 28 forces air through exit slit 80 which forms an air knife and withdraws or sucks air via exit port 82. Similarly, dryer 30 forces air toward surface 66 via chamber 84 and sucks or withdraws air away from surface 66 via chamber 86. In other embodiments, other dryers or drying mechanisms may be employed or dryers 28 and 30 may be omitted.

Impression cylinder 32 comprises a cylinder adjacent to intermediate transfer member 24 so as to form a nip 94 between member 24 and cylinder 32. Media 12 is generally fed between intermediate transfer member 24 and impression cylinder 32, wherein printing material is transferred from intermediate transfer member 24 to medium 12 at nip 94. Although impression member 32 is illustrated as a cylinder or roller, impression member 32 may alternatively comprise an endless belt or a stationary surface against which intermediate transfer member 24 moves.

Cleaning station 34 is arranged proximate to surface 66 between the intermediate transfer member 24 and charger 16. Cleaning station 34 comprises one or more devices configured to remove residual ink and electrical charge from surface 42. In particular examples shown, cleaning station 34 flows a cooled liquid, such as a carrier liquid, across surface 66 between rollers 87, 88. Adhered toner particles are removed by roller 88, which is absorbent. Particles and liquids picked up by the absorbent material of roller 88 is squeegeed out by a squeegee roller 90. The cleaning process of surface 42 is completed by station 34 using a scraper blade 92 which scrapes any remaining toner or ink from surface 66 and keeps the carrier liquid from leaving cleaning station 34. In other embodiments, other cleaning stations may be employed or cleaning station 34 may be omitted.

In operation, charger 16 electrostatically charges surface 42. Surface 42 is exposed to light from imager 18. In particular, surface 42 is exposed to laser 50 which is controlled by a raster image processor that converts instructions from a digital file into on/off instructions for laser 50. This results in a latent image being formed for those electrostatically discharged portions of surface 42. Ink developer units 20 develop an image upon surface 42 by applying ink to those portions of surface 42 that remain electrostatically charged. In the embodiment shown, printing material contains approximately 2% solids of colorant particles prior to being applied to developer roller 60 of each developer unit 20. Printing material has an approximately 6 micron thick film with approximately 20% solids on developer roller 60 prior to being applied to surface 42.

Once an image upon surface 42 has been developed, eraser 22 erases any remaining electrical charge upon surface 42 and the ink image is transferred to surface 66 of intermediate transfer member 24. In the embodiment shown, printing material forms an approximately 1.4 micron thick layer of approximately 85% solids colorant particles with relatively good cohesive strength upon surface 66.

Once the printing material has been transferred to surface 66, heat is applied to printing material so as to melt toner binder resin of the colorant particles or solids of printing material to form a hot melted adhesive. Dryers 28 and 30 partially dry the melted liquid colorant particles. Thereafter, the layer of melted colorant particles forming an image upon surface 66 is transferred to media 12 passing between transfer member 24 and impression cylinder 32. In the embodiment shown, the melted colorant particles are transferred to print media 12 at approximately 90 degrees Celsius. The layer of melted colorant particles freeze to media 12 on contact in the nip formed between intermediate transfer member 24 and impression cylinder 32. Thereafter, any remaining printing material and surface 42 is removed by cleaning station 34.

These operations are repeated for every color for preparation in the final image to be produced. In other embodiments, in lieu of creating one color separation at a time on surface 66, sometimes referred to as "multi-shot" process, the above-noted process may be modified to employ a one-shot color process in which all color separations are layered upon surface 66 of intermediate transfer member 24 prior to being transferred to and deposited upon medium 12.

Figure 2:
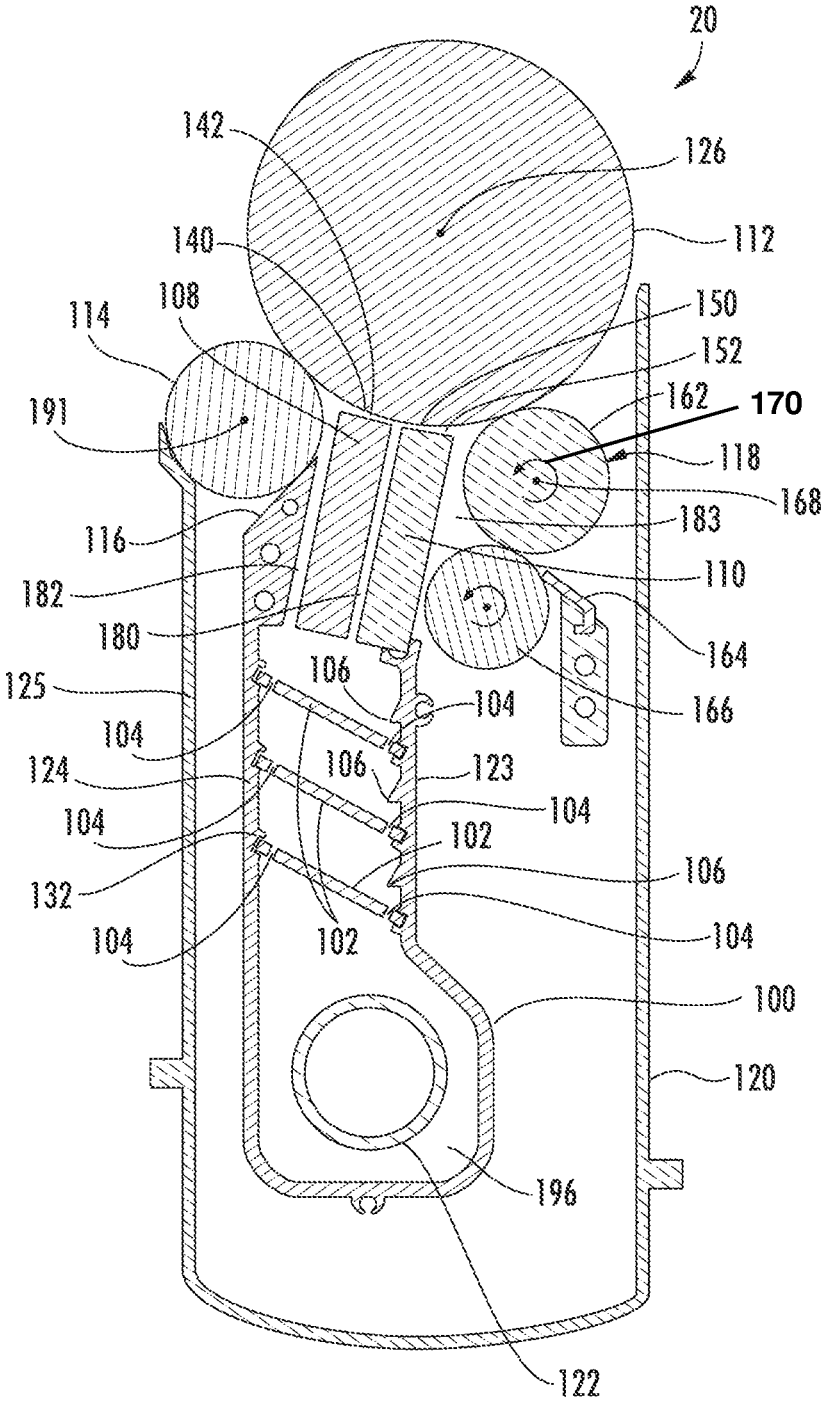
FIG. 2 is a sectional view of a developer of the printer of FIG. 1 according to an example embodiment.

FIGS. 2-8 illustrate one of development units 20 in detail. As shown by FIG. 2, each developer unit 20 generally includes toner or ink inlet chamber 100, baffles 102, flow openings 104, flow directors 106, main electrode 108, back electrode 110, developer roller 112, squeegee roller 114, squeegee cap 116, developer cleaning system 118 and reservoir 120. Inlet chamber 100 comprises a cavity having an inlet opening 122 through which printing material or ink is supplied to chamber 100. In the example illustrated, chamber 100 is partially surrounded by and is located within reservoir 120. Chamber 100 includes a pair of opposite walls 123, 124 forming a neck portion 125. Wall 123 terminates at or is sealed against back electrode 110 while wall 124 supports squeegee cap 116. In other embodiments, chamber 100 may have other configurations.

Figure 3:
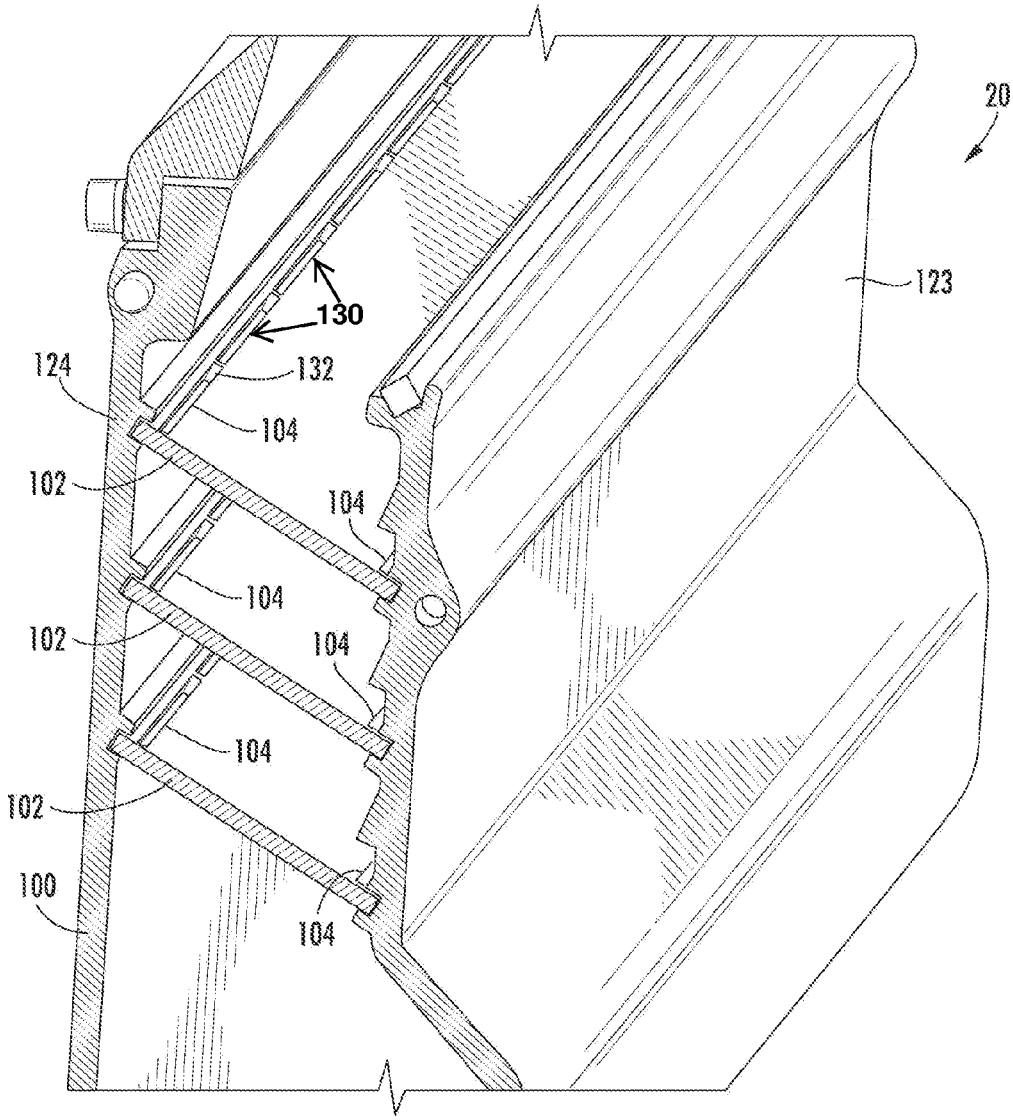
FIG. 3 is an enlarged fragmentary perspective view of a portion of the developer of FIG. 2 according to an example embodiment.

As shown by FIGS. 2 and 3, baffles 102 comprise flow inhibiting and directing structures, such as panels, floors, walls and the like. Baffles 102 are supported so as to extend longitudinally along a rotational axis 126 of developer roller 112 between inlet opening 122 and electrodes 108,110. Each of baffles 102 extends between walls 123 and 124. Baffles 102 impede ink flow such that a pressure of the ink flow across a longitudinal length of baffles 102 is more uniform.

Flow passages or openings 104 extend from a first or lower side of each baffle 102 to a second or upper side of each baffle 102. Openings 104 allow the flow of ink in a controlled manner from inlet opening 122 towards electrodes 108, 110. According to one embodiment, each of openings 104 has a transverse dimension of least 1 mm and less than or equal to 3 mm. Because each of openings 104 has a transverse dimension of at least 1 mm, ink flow of sufficient pressure, without large pressure drops, is provided to electrodes 108, 110 without relatively large input pressures at inlet opening 122. Because openings 104 have a transverse dimension of less than 3 mm, ink pressure uniformity across electrodes 108, 110 in a longitudinal direction is enhanced. In other embodiments, openings 104 may have other transverse dimensions.

In the example illustrated, openings 104 are located at opposite transverse ends (left and right ends as seen in FIG. 2) of baffles 102 adjacent to or along walls 123, 124, respectively. As a result, corners on a top side of each baffle 102 between baffle 102 and one of walls 123, 124 are reduced in size or are eliminated to reduce locations where ink sediment may collect. Corners on a bottom side of each baffle 102 between baffle 102 and one of walls 123, 124 are reduced in size or are eliminated to reduce locations where air bubbles may collect. In other embodiments, openings 104 may extend through intermediate portions of each of baffles 102. Although each of baffles 102 are illustrated as having a pair of such openings 104, in other embodiments, baffles 102 may have a single opening 104 or more than two openings 104.

As shown by FIG. 3, in the example illustrated, openings 104 comprise elongate slots 130 separated by support ribs 132. Support ribs 132, collectively, have a longitudinal length of less than 10% longitudinal length of each baffle 102 and are spaced apart from one another by approximately 150 mm. In one embodiment, each of ribs 132 has a longitudinal length of 1 mm to 2 mm. Ribs 132 strengthen baffle 102. In other embodiments, ribs 132 may have other configurations or may be omitted. In other embodiments, openings 130 may have other dimensions and other configurations.

Figure 4:
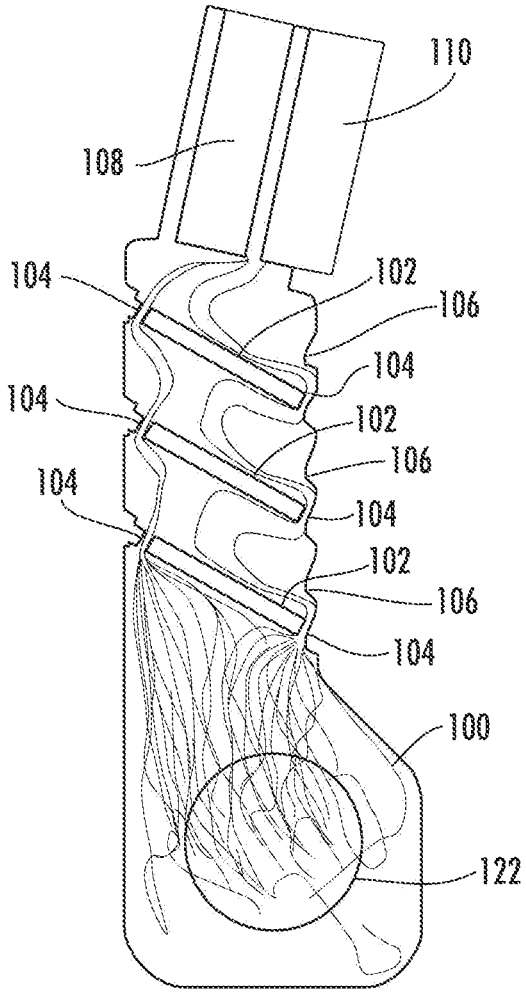
FIG. 4 is a sectional view of the developer of FIG. 2 illustrating liquid flow through the developer according to an example embodiment.

Flow directors 106 comprise projections, protruberances, bumps, wings, fingers or other structures overlapping and extending across openings 104 along wall 123. In the example illustrated, flow directors 106 are located within a gap or space between consecutive baffles 102. Flow directors 106 extend from wall 123 over the underlying openings 104. Flow directors 106 extend completely across and beyond (to the left as seen in FIG. 2) of each opening 104 adjacent wall 123. In one embodiment, flow directors 106 extend up to 10 mm beyond or past the underlying opening 104. As shown by FIG. 4, flow directors 106 redirect or bend flow of ink in a transverse direction from wall 123 towards wall 124. The transverse flow facilitated by flow directors 106 breaks or reduces ink stagnation between consecutive baffles 102 while washing away and reducing sediment or sludge buildup. In other embodiments, flow directors may also or alternatively be provided opposite to the openings 104 adjacent wall 124.

Figure 5:
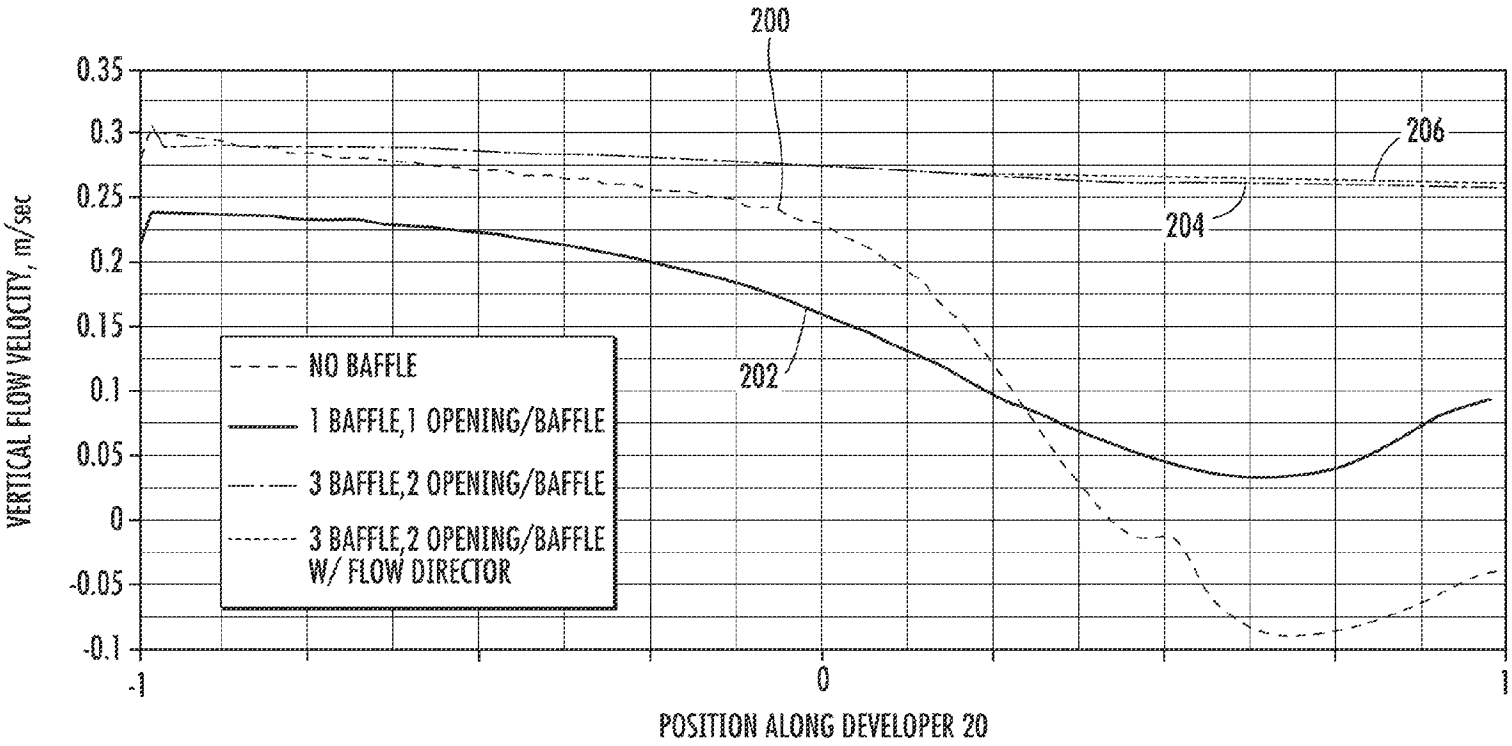
FIG. 5 is a graph illustrating the vertical flow velocity across a longitudinal length of different developers without baffles and with different baffle configurations.

FIG. 5 is a graph illustrating the vertical flow velocity (the velocity of ink flow in a linear direction from ink inlet 122 towards electrodes 108, 110) across a longitudinal length of baffles 102 and electrodes 108, 110 for different developers without baffles 102 and with different baffle configurations. In the example illustrated, developer roller 112 of developer 20 has a longitudinal length of at least 0.5 meters. The longitudinal center of developer roller 112 is identified with a 0 on the abscissa of the graph with the ends of developer roller 112 identified with −1 and +1 on the abscissa, wherein inlet opening 122 of developer 20 is at one end (+1) of developer 20 (the far right side of the graph of FIG. 5).

The data points forming line 200 indicate the vertical flow velocity along the longitudinal length of developer 20 without any baffles 102. The data points forming line 202 indicate the vertical flow velocity along the longitudinal length of developer 20 when developer 20 includes a single baffle 102 having a single longitudinally extending opening 104. The data points forming line 204 indicate the vertical flow velocity along the longitudinal length of developer 20 when developer 20 includes three baffles 102 as shown in FIG. 2 and two transversely spaced openings 104 for each baffle 102. The data points forming line 206 indicate the vertical flow velocity along the longitudinal length of developer 20 when developer 20 includes three baffles 102 and two transversely spaced openings 104 for each baffle, wherein each opening 104 across the two lower baffles has the flow directors 106 as shown in FIG. 2.

As shown by data line 200 and FIG. 5, developer 20 without any baffles 102 experiences large vertical flow velocity differentials across the longitudinal length of developer 20. High vertical flow velocities exist at the far end of developer 20 opposite inlet opening 122 while relatively low vertical flow velocities or pressures exist proximate to inlet opening 122. As indicated by data line 202, with the addition of a single baffle 102 having a single opening 104, the vertical flow velocity at the far end is lowered while the vertical flow velocity at the near end, proximate inlet opening 122 is increased to achieve a more uniform vertical flow velocity along the longitudinal length of developer 20. As indicated by data lines 204 and 206, providing developer 20 with three baffles 102 and two openings across each baffle increases the vertical flow velocity at the far end of developer 20 but also substantially increases the vertical flow velocity at the end of developer 20 proximate to inlet opening 122 to achieve a substantially uniform vertical flow velocity along the entire longitudinal length of developer 20. As shown by line 206 the provision of flow directors 106 do not reduce this uniformity, but additionally reduce ink stagnation. By providing a more uniform vertical flow velocity along the length of developer 20 and providing a more uniform ink flow to electrodes 108, 110 along the longitudinal length of developer 20, enhanced development quality may be achieved with more uniform development and less streaking.

Referring once again to FIG. 2, main electrode 108 comprises an electrically conductive member supported above or opposite to chamber 100 so as to be substantially enclosed or surrounded on all sides by chamber 100, back electrode 110, developer roller 112, squeegee roller 114 and squeegee cap 116. In the example illustrated, main electrode 108 has a face 140 opposite to and facing developer roller 112. In the example illustrated, face 140 is substantially flat, so as to be contained in a plane tangent to the external circumferential surface of roller 112. In the example illustrated, all points of face 140 lie along a flat plane. Because face 140 is substantially flat (non-arced), main electrode 108 is simpler in construction and manufacture.

In the example illustrated, face 140 is spaced from the outer circumferential surface of developer roller 112 by a gap 142. It is in this gap 142 that ink flows between electrode 108 and developer roller 112 and in which ink is developed upon selectively charged portions of developer roller 112. In the example illustrated, gap 142 has a thickness of at least 800 μm. In one embodiment, gap 142 has a thickness greater than or equal to 800 μm and less than or equal to 1000 μm. Because gap 142 has a thickness or provides a spacing of at least 800 μm, developer 20 may accommodate larger variations in the manufactured dimensions or tolerances of electrode 108 and developer roller 112. In other words, any variations in the configuration of developer roller 112 causing the actual gap 142 to be different than the specified gap will be a smaller percentage of the specified gap as compared to other developer architectures having a smaller specified gap. As a result, developer 20 may utilize developer rollers 112 having a longer longitudinal length and electrode 108, 110 having a corresponding longer longitudinal length (along axis 126) with a reduced likelihood that the greater manufacturing variations associated with such longer developer rollers and longer electrodes will substantially impact performance of developer 20. In one embodiment, developer roller 112 has a longitudinal length of at least 0.5 m. The longer developer rollers allow printing upon wider medium.

The larger spacing provided by gap 142 may additionally allow bid 20 to have the same length of developer roller 112, but with reduced ink flow at inlet 122. Reducing ink flow at inlet 122 may reduce operational costs for developer 20 and printing system 10. In one embodiment, gap 142 is sized such that developer 20 operates with an ink flow or a pressure (as measured at inlet 122) of less than or equal to 0.026 liters per minute per mm in axial or longitudinal length for developer roller 112.

The larger spacing provided by gap 142 further reduces development defects such as streaks. In other embodiments, the spacing provided by gap 142 may be tuned to accommodate different architectures of developer 20. In some embodiments, the spacing provided by gap 142 may be 1000 μm or less.

Back electrode 110 comprises an electrically conductive member supported above or opposite to chamber 100. In the example illustrated, back electrode 110 cooperates with wall 123 to partially enclose main electrode 108 within the volume of chamber 100. Back electrode 110 extends between main electrode 108 and developer cleaning system 118. Back electrode 110 includes a face 150 that faces and extends opposite to developer roller 112. In the example illustrated, face 150 is substantially flat, so as to be contained in a plane tangent to the external circumferential surface of roller 112 such that all points of face 150 lie along a flat plane. Because face 150 is substantially flat (non-arced), back electrode 110 is simpler in construction and manufacture.

In the example illustrated, face 150 is spaced from the outer circumferential surface of developer roller 112 by a gap 152. It is in this gap 152 that ink flows between electrode 110 and developer roller 112 and in which ink is developed upon selectively charged portions of developer roller 112. Ink flowing through gap 152 flows into contact with developer cleaning system 118 to assist in removing or washing away sludge and any aggregated ink particles to prevent sludge buildup prior to the ink flowing into reservoir 120. In the example illustrated, gap 152 has a thickness of at least 800 μm. In one embodiment, gap 152 has a thickness greater than or equal to 800 μm and less than or equal to 1000 μm. in other embodiment, gap 152 may have other thicknesses.

During operation of developer 20, back electrode 110 and main electrode 108 are maintained at the same electrical potential. As a result, in some embodiments, back electrode 110 and main electrode 108 may comprise a single unitary structure. In other embodiments, electrodes 108 and 110 may comprise separate structures separately mounted or supported by developer 20 with respect to developer roller 112. In the example illustrated, each of electrodes 108, 110 comprise elongate rectangular bars and are removably mounted along the developer roller 112.

In the example illustrated, faces 140 and 150 of electrodes 108 and 110 and their associated gaps 142 and 152 are dimensioned such that at least 50% of the total amount of development of ink at each developed spot upon developer roller 112 occurs between back electrode 110 and developer roller 112. Because at least 50% of the total development is achieved using back electrode 110, enhanced development of ink along developer roller 112 is achieved, reducing streaking. According to one embodiment, faces 140 and 150 of electrode 108 and 110 and their associated gaps 142 and 152, respectfully, have substantially the same dimensions.

Developer roller 112 comprises a roller configured to be rotatably driven and electrically charged to a voltage distinct from the voltage of electrodes 108 and 110 so as to attract electrically charged ink particles or colorant particles of ink as roller 112 is rotated. Roller 112 is charged such that the charged ink particles being carried by roller 112 are further attracted and drawn to those portions of surface 42 that are electrostatically charged.

Squeegee roller 114 removes excess ink from the surface of roller 112. In particular embodiments, squeegee roller 114 may be selectively charged to control the thickness or concentration of ink upon the surface of roller 112. In the example shown, electrodes 108, 110 and squeegee roller 114 are appropriately charged with respect to roller 112 so as to form a substantially uniform 6 micron thick film composed of approximately 20% solids on the surface of roller 112 which is substantially transferred to surface 42 (shown in FIG. 1).

Squeegee cap 116 extends between electrode 108 and squeegee roller 114. Squeegee cap 116 inhibits overflow at squeegee roller 114. Although squeegee cap 116 is illustrated as being mounted to a top of wall 124 of chamber 100, and other embodiments, squeegee cap 116 may be integrally formed as part of wall 124 and may have other configurations.

Developer cleaning system 118 removes printing material or ink from developer roller 112 which has not been transferred to surface 42. The removed ink is moved to a reservoir in which colorant particles or solid content of the liquid or fluid is precisely monitored and controlled. In the example illustrated, developer cleaning system 118 includes developer cleaner 162, wiper 164 and sponge roller 166.

Developer cleaner 162 comprises a roller having a surface charged so as to attract and remove the printing material from the surface of roller 112. In one particular embodiment in which developer roller 112 has a charge of approximately negative 450 volts, cleaner 162 has a charge of approximately negative 125 volts. Developer cleaner 162 is located in close proximity to developer roller 112 near an upper portion of reservoir 120. In the particular example shown, cleaner 162 is configured to be rotatably driven about axis 168 while in engagement with wiper 164. Although cleaner 162 is illustrated as a roller, cleaner 162 may alternatively comprise a belt movably supported by one or more rollers, wherein a surface of the belt is positioned proximate to developer roller 112 and may be electrically charged for removing printing material from developer roller 112.

Wiper 164 comprises a scraper blade supported within reservoir 120 and in close proximity or in contact with the surface of cleaner 162. In the particular example shown, cleaner 162 rotates in a direction indicated by arrow 170 against wiper 164 such that the printing material is removed from the surface of cleaner 162.

Sponge roller 166 comprises a rotatably driven roller form from one or more compressible absorbent sponge-like materials. Sponge roller 166 extends into contact with cleaner 162, electrode 110 and wiper 164 so as to further remove or wipe away sludge and other ink particles from each of cleaner 162, electrode 110 and wiper 164. In other embodiments, developer cleaning system 118 may include other structures or mechanisms for removing build up from one or more of cleaner 162, electrode 110 or wiper 164.

As noted above, the overall architecture of developer 20 provides enhanced flexibility for the size, shape and positioning of its development electrodes. This flexibility is provided in part by developer 20 providing an ink flow passage that returns ink that has flowed across gap 142 directly back to the interior of chamber 100. As shown by FIG. 2, developer 20 has an architecture that provides an intake passage 180, a return passage 182, and a cleaner side discharge passage 183.

Intake passage 180 extends between electrode 108 and 110 so as to supply ink to each of gaps 142 and 152. Return passage 182 extends from gap 142 back to the interior of chamber 100. In the example illustrated in FIG. 2, return passage 182 is bordered or is bound on opposite sides (1) by squeegee roller 114 and electrode 108 proximate to developer roller 112 and (2) by squeegee cap 116 and electrode 108 proximate to the interior of chamber 100. As a result, electrode 108 is suspended such that there is an ink path completely around electrode 108 on all four sides (the left side, the right side, the top and the bottom, as seen in FIG. 2). In other embodiments, return ink passage 182 may be defined by additional or alternative structures.

Cleaner side discharge passage 183 extends from gap 152 to and along cleaning system 118. Cleaner side discharge passage 183 directs ink that has moved across gap 152 to cleaning system 118. The flow of ink to cleaning system 118 through and along discharge passage 183 facilitates washing of sludge and solids that may have built up. In the example illustrated, passage 183 is bordered on one side by electrode 110 such that ink flow may wash accumulation from a side of electrode 110 opposite intake passage 180.

Figure 6:
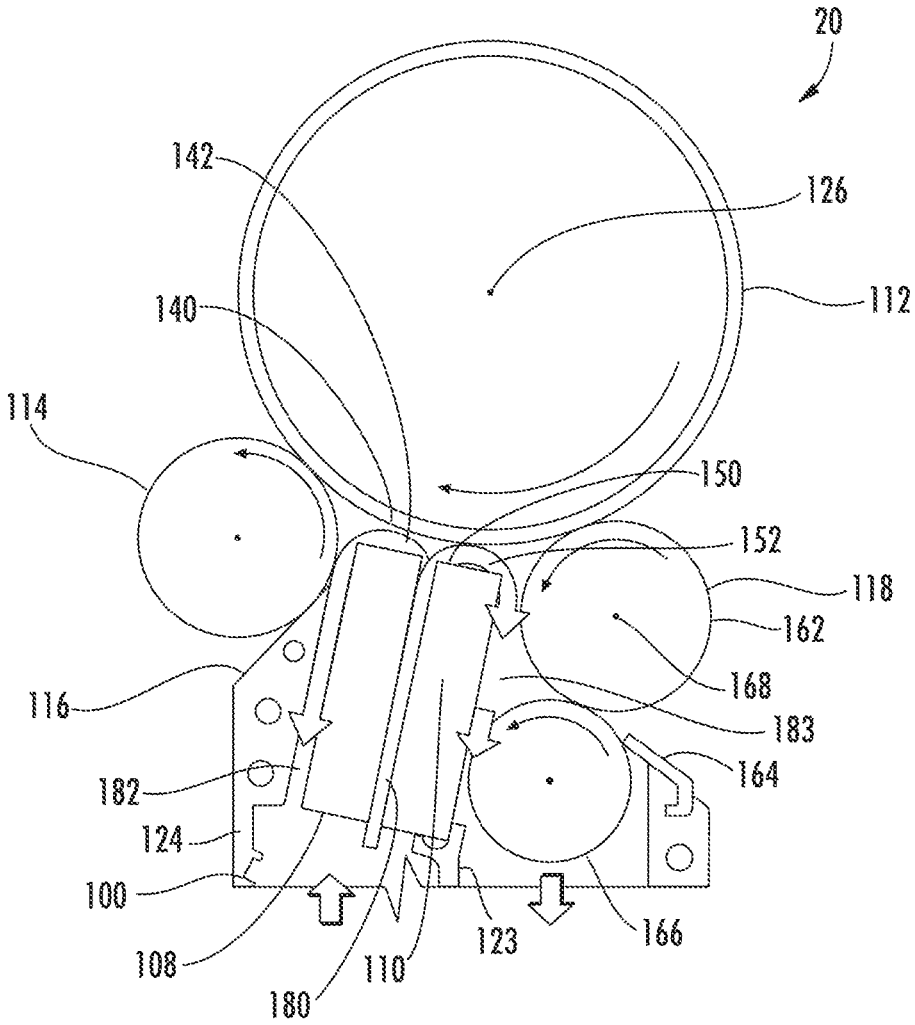
FIG. 6 is a fragmentary sectional view of a portion of the developer of FIG. 2 illustrating liquid flow through the developer according to an example embodiment.

FIG. 6 illustrates ink circulation provided by the architecture of developer 20. As shown by FIG. 6, ink supplied through inlet 122 (shown in the FIG. 2) flows through intake passage 180 between electrode 108 and 110 towards developer roller 112. A portion of the ink is pumped by developer roller 112 across gap 142. Portions of ink not developed upon roller 112 returns to the interior 196 of chamber 100 through return passage 182. The pressure of the fluid supplied through intake passage 180 further forces a portion of the ink to flow across gap 152 and through cleaner side discharge passage 183

Because ink that has been pumped across gap 142 and across main electrode 108 is recirculated back to chamber 100, the thickness of gap 142 may be increased and/or the length of face 140 of main electrode 108 may be reduced without starving or substantially decreasing ink flow across back electrode 110 and without having to substantially increase the rate at which ink is supplied to chamber 100 through inlet 122. By way of contrast, in designs where all the ink that has flowed past the main electrode and the developer roller is returned to reservoir, the flow across the main electrode depends upon the pumping action of the rotation of roller 112 which is dependent upon the thickness of the gap between the main electrode and the developer roller. In such designs, the flow of ink across the back electrode is dependent upon the pressure caused by a difference between the rate at which ink is supplied to chamber 100 through inlet 122 and the rate at which ink is discharged and returned to the reservoir. In such designs, increasing the gap between the main electrode and the developer roller causes a greater volume of ink to be pumped out to the reservoir, starving or detrimentally reducing flow to the back electrode unless the rate at which ink is supplied through inlet 122 is increased. In such designs, decreasing a length of the main electrode produces similar results—the flow of ink to the back electrode is starved unless the rate at which ink is supplied through inlet 122 is increased.

In contrast, because developer 20 recirculates ink that has moved across gap 142 immediately and directly back to chamber 100, the thickness of gap 142 as well as the length of face 140 may be adjusted without starving or substantially reducing ink flow to back electrode 110 and without having to substantially increase a rate of ink flow through inlet 122. Although increasing the thickness of gap 142 or decreasing the length of face 140 increases the flow across gap 142, the excess flow across gap 142 is immediately returned to chamber 100. As a result, the architecture of developer 20 facilitates a large degree of control over the thickness of gap 142 and the length of face 140. Likewise, the architecture of developer 20 provides great flexibility in the relative thicknesses of gaps 142 and 152 as well as the relative lengths of faces 140 and 150. Consequently, gaps 142, 152 and faces 140, 150 may be more freely adjusted to reduce the size of developer 20, to reduce tolerance related concerns and to reduce manufacturing costs and complexity of developer 20. As noted above, in one embodiment, gap 142 is provided with a thickness of at least 800μ. Gap 152 is also provided with a thickness of at least 800μ.

In addition to being spaced from developer roller 112 by relatively large gaps 142, 152, face 140 of main electrode 108 and face 150 of back electrode 110 each have a relatively short transverse length or width. According to one embodiment, each of faces 140 and 150 has a length of less than or equal to 20 mm and nominally 10 mm. The combination of the relatively large gaps 142, 152 and the relatively short widths provide a more uniform electrostatic field across the width of each of electrodes 108, 110 as compared to electrodes having a longer width and smaller spacings from developer roller 112.

As further shown by FIG. 2, because face 140 of main electrode 108 may be provided with a reduced transverse length or width, the overall angular extent of electrodes 108, 110 about developer roller 112 may be reduced. This allows squeegee roller 114 to be angularly positioned closer to cleaner roller 162 with respect to the rotational axis 126 of developer roller 112. In the example illustrated, rotational axis 168 of cleaner roller 162 is angularly spaced from the rotational axis 191 of squeegee roller 114 by an arc of at least 180 degrees centered about rotational axis 126 of developer roller 112 and extending in an upstream direction (counterclockwise about axis 126 as seen in FIG. 2) about developer roller 112 from rotational axis 168 to rotational axis 191. As a result, developer roller 112 may be more easily made removable or is removable from the remainder of developer 20 since developer roller 112 is not captured or trapped between rollers 114 and 162.

In addition, developer 20 occupies less circumferential space about surface 42 (shown in FIG. 1) of drum 14. As a result, additional space is freed about drum 14, allowing more room for additional developers 20 or for other components. In the embodiment illustrated, rotational axis 168 of cleaner roller 162 is angularly spaced from the rotational axis 191 of squeegee roller 114 by an arc of at least 180 degrees centered about rotational axis 126 of developer roller 112 and extending in an upstream direction (counterclockwise about axis 126 as seen in FIG. 2) about developer roller 112 from rotational axis 168 to rotational axis 191. In other embodiments, the angular spacing between rollers 114 and 162, facilitated by the shorter transverse length or width of main electrode 108, may have different values.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A liquid electrophotography (LEP) ink developer comprising:

a developer roller;

an ink inlet chamber;

a first electrode between the inlet chamber and the developer roller, the first electrode being spaced from the developer roller by a first gap;

a second electrode between the inlet chamber and the developer roller, the second electrode being spaced from the developer roller by a second gap; and an ink flow path extending from the inlet chamber on a first side of the first electrode between the first electrode and the second electrode, through the first gap and back to the inlet chamber.

2. The developer of claim 1, further comprising:

a squeegee cap; and a squeegee roller in contact with the squeegee cap and the developer roller, wherein the ink flow path is partially defined on a first side by the first electrode and on a second side opposite the first side by the squeegee roller.

3. The developer of claim 1, wherein the first gap is greater than or equal to 800 μm and less than or equal to 1000 μm.

4. The developer of claim 1, wherein the second electrode has a length along the developer roller and wherein the second gap and the length are sized such that the second electrode develops at least 50% of ink developed on the developer roller.

5. The developer of claim 1, wherein a downstream edge of the second electrode is spaced from an upstream edge of the first electrode by less than or equal to about 25 mm.

6. The developer of claim 1 further comprising:

a cleaner roller in contact with the developer roller upstream the second electrode; and a squeegee roller in contact with the developer roller downstream the first electrode, wherein a rotational axis of the cleaner roller is angularly spaced from a rotational axis of the squeegee roller by an arc of at least 180 degrees centered about a rotational axis of the developer roller and extending in an upstream direction about the developer roller from the rotational axis of the cleaner to the rotational axis of the squeegee roller.

7. The developer of claim 1, wherein the developer roller has an axial length of at least 0.5 m.

8. The developer of claim 1, wherein the first electrode and the second electrode have flat faces facing the developer roller.

9. The developer of claim 1 further comprising:

at least one baffle extending longitudinally along a rotational axis of the developer roller, the at least one baffle extending between an inlet opening of the inlet chamber and the first electrode; and a first opening extending from a first side of each baffle to a second side of each baffle opposite the first side of each baffle.

10. The developer of claim 9, wherein the at least one baffle includes three baffles.

11. The developer of claim 9, wherein the first opening of each baffle has a transverse dimension greater than or equal to 1 mm and less than 3 mm.

12. The developer of claim 9 further comprising a second opening transversely spaced from the first opening and extending from the first side of each baffle to the second side of each baffle opposite the first side of each baffle.

13. The developer of claim 12, wherein the first opening is adjacent a first transverse end of each baffle and wherein the second opening is adjacent a second transverse end of each baffle opposite the first transverse end of each baffle.

14. The developer of claim 9 further comprising a flow director overlapping and extending across the first opening.

15. A method comprising:

supplying ink to an ink inlet chamber; and flowing ink from the ink inlet chamber along a first side of a first electrode and between the first electrode and a second electrode, through a gap between the first electrode and a developer roller and back to the inlet chamber;

wherein the first and second electrodes are between the inlet chamber and the developer roller but spaced apart from the developer roller.

* * * * *